US007185780B2

(12) United States Patent
Nomula

(10) Patent No.: US 7,185,780 B2
(45) Date of Patent: Mar. 6, 2007

(54) CONTAINER OVERCAP WITH DRYING AGENT LAYER

(75) Inventor: Srinivas Nomula, Hartsville, SC (US)

(73) Assignee: Sonoco Develpoment, Inc., Hartsville, SC (US)

( * ) Notice: Subject to any disclaimer, the term of this patent is extended or adjusted under 35 U.S.C. 154(b) by 503 days.

(21) Appl. No.: 10/736,383

(22) Filed: Dec. 15, 2003

(65) Prior Publication Data

US 2005/0127082 A1 Jun. 16, 2005

(51) Int. Cl.
*B65D 53/04* (2006.01)

(52) U.S. Cl. ..... 220/359.3; 229/125.01; 229/125.16; 229/795; 229/806

(58) Field of Classification Search ..... 220/359.3, 220/780, 795, 796, 806; 215/347, 261; 229/125.16, 125.01, 123.1, 123.2; 206/204
See application file for complete search history.

(56) References Cited

U.S. PATENT DOCUMENTS 2,196,021 A * 4/1940 Merrill ..... 96/118
3,916,578 A * 11/1975 Cullen et al. ..... 206/204
4,048,361 A 9/1977 Valyi
4,279,350 A 7/1981 King
4,785,952 A 11/1988 Obadia
4,792,484 A * 12/1988 Moritani ..... 428/323
4,840,280 A 6/1989 Schvester
5,227,411 A 7/1993 Hofeldt et al.
5,270,337 A 12/1993 Graf
5,274,024 A 12/1993 Koyama et al.
5,542,557 A 8/1996 Koyama et al.
5,806,681 A 9/1998 Frisk
5,830,545 A 11/1998 Frisk
5,839,593 A 11/1998 McKedy
5,934,494 A 8/1999 Takahashi et al.
6,080,350 A 6/2000 Hekal
6,113,927 A 9/2000 Hatakeyama
6,124,006 A * 9/2000 Hekal ..... 428/34.1

(Continued)

FOREIGN PATENT DOCUMENTS

FR 2 837 173 9/2003

OTHER PUBLICATIONS

Search Report for corresponding European Appl. No. 04 25 7394 completed Mar. 23, 2005.

*Primary Examiner*—Nathan J. Newhouse
*Assistant Examiner*—James Smalley
(74) *Attorney, Agent, or Firm*—Alston & Bird LLP

(57) ABSTRACT

There is provided an overcap for a resealable container that includes a drying agent layer. The drying agent layer is included in a top portion of the overcap and is positioned below a top layer of the top portion such that the drying agent layer is exposed to the interior of the container. The overcap may be formed from a multilayered coextruded sheet having a top layer of polymer material and a drying agent layer mixed with a polymer material. The multilayered coextruded sheet may also include a barrier layer, a polymer layer, and/or additional drying agent layers. Alternatively, the drying agent layer may be joined to the overcap by an injection molding process or by an adhesive. The drying agent layer is exposed to moisture in the interior of the container such that the drying agent layer is operable to absorb moisture from the air that enters the interior of the container during the opening and resealing of the container.

18 Claims, 3 Drawing Sheets

U.S. PATENT DOCUMENTS 6,135,273 A * 10/2000 Cuen ..... 206/204
6,500,519 B2 12/2002 Ishizaki et al.
6,503,587 B2 1/2003 Kashiba et al.
6,571,942 B2 * 6/2003 Riemenschneider et al. ..... 206/204
6,696,002 B1 * 2/2004 Hekal ..... 264/239
6,881,286 B2 * 4/2005 Drummond et al. ..... 156/69
6,986,807 B2 * 1/2006 Brunk ..... 96/147
2002/0146527 A1 10/2002 Kikuchi et al.
2002/0155233 A1 10/2002 McKnight
2003/0057175 A1 3/2003 Willingham et al.
2003/0082321 A1 5/2003 Kennedy et al.
2003/0222046 A1 * 12/2003 Schenck et al. ..... 215/341

* cited by examiner

CONTAINER OVERCAP WITH DRYING AGENT LAYER

FIELD OF THE INVENTION

The present invention relates generally to containers with removable overcaps. More particularly the invention relates to a container overcap with a drying agent layer incorporated into the overcap to absorb moisture from the interior of the container.

BACKGROUND OF THE INVENTION

Containers that store perishable goods, such as food products, often include resealable lids or overcaps so that after the container is first opened, the remaining product can be resealed inside the container. Resealing the container prevents the stored product from exposure to oxygen, moisture, and contaminants from the surrounding atmosphere; however, such oxygen, moisture, and contaminants may enter the interior of the container while the overcap is not connected. Such oxygen, moisture, and contaminants are then sealed into the container when the overcap is replaced. This limited amount of oxygen, moisture, and contaminants can expedite the spoilage of the stored perishable goods. Moisture can also render the product less crisp than may be desired.

To reduce moisture within a container, whether the container is sealed or unsealed, it is well known in the art to include a drying agent in the container to absorb moisture. Silica gel packets are a typical example of a drying agent inserted into a container to absorb moisture. However, such loose packets are not appropriate in every type of container, such as food containers. A loose drying agent could contaminate the stored products or could be accidentally ingested by inattentive consumers.

Therefore a need exists for a drying agent that can be included in a container without possible adverse effects on the stored product or the consumer.

BRIEF SUMMARY OF THE INVENTION

The invention addresses the above needs and achieves other advantages by providing an overcap for sealing an opening of a container and reducing an amount of moisture within the container. The overcap has a top portion with an outside or top surface and an inside or bottom surface such that the overcap covers the opening of the container with the inside surface of the overcap facing an interior of the container. The overcap also includes a connecting portion extending from the top portion. The connecting portion creates a sealed interface with the container when attached to the container. A drying agent layer is incorporated into the overcap such that it is exposed to moisture within the interior of the container and is operable to absorb moisture from the interior of the container.

In one embodiment of the invention, the drying agent layer is incorporated into the top portion of the overcap below a top layer such that the drying agent layer is directly exposed to the interior of the container. For example, the drying agent layer can be dispersed in a polymer material that forms a bottom layer of the top portion. The overcap can include one or more other layers in addition to the top and bottom layers, and one or more of the other layers can also include drying agent if desired.

In another embodiment of the invention, a layer incorporating a drying agent can be positioned between other layers that do not include a drying agent, such that the drying agent layer is not directly exposed to the interior of the container. In this embodiment, any layer(s) disposed between the drying agent layer and the interior of the container should be formed of a material that is relatively permeable to water vapor so that the drying agent layer can absorb moisture from the container interior. In all embodiments, any layer(s) disposed between the drying agent layer and the outside atmosphere should be relatively impermeable to water vapor so that the drying agent layer absorbs moisture primarily from the interior of the container rather than from the outside atmosphere. Thus, in a preferred embodiment, a barrier layer that is relatively impermeable to water vapor is included in the overcap and is positioned outwardly of the drying agent layer.

Overcaps in accordance with the invention can be formed by various processes. In one embodiment, an overcap is thermoformed from a coextruded sheet. A multilayered sheet is coextruded to include at least two layers, wherein at least one layer incorporates a drying agent. Alternatively, a drying agent layer can be formed separately from the overcap and can then be joined below the top layer of the top portion with an adhesive or the like.

Still another suitable method for creating an overcap is injection molding. A drying agent layer such as a layer incorporating a drying agent may be positioned in a mold such that injection of a thermoplastic material joins the drying agent layer to the overcap during the subsequent hardening of the overcap. The drying agent layer can form the inside surface of the top portion of the overcap.

The invention thus provides an overcap that incorporates a drying agent layer as an integral part of the overcap to reduce moisture in a sealed container. Because the drying agent layer is an integral part of the overcap, the drying agent is prevented from mixing with the stored product, and direct contact between the drying agent and the stored product is minimized or eliminated. Therefore, the drying agent layer potentially improves the shelf life and/or crispness of the stored product in the container without adversely affecting the quality or use of the stored product.

BRIEF DESCRIPTION OF THE SEVERAL VIEWS OF THE DRAWINGS

Figure 1:
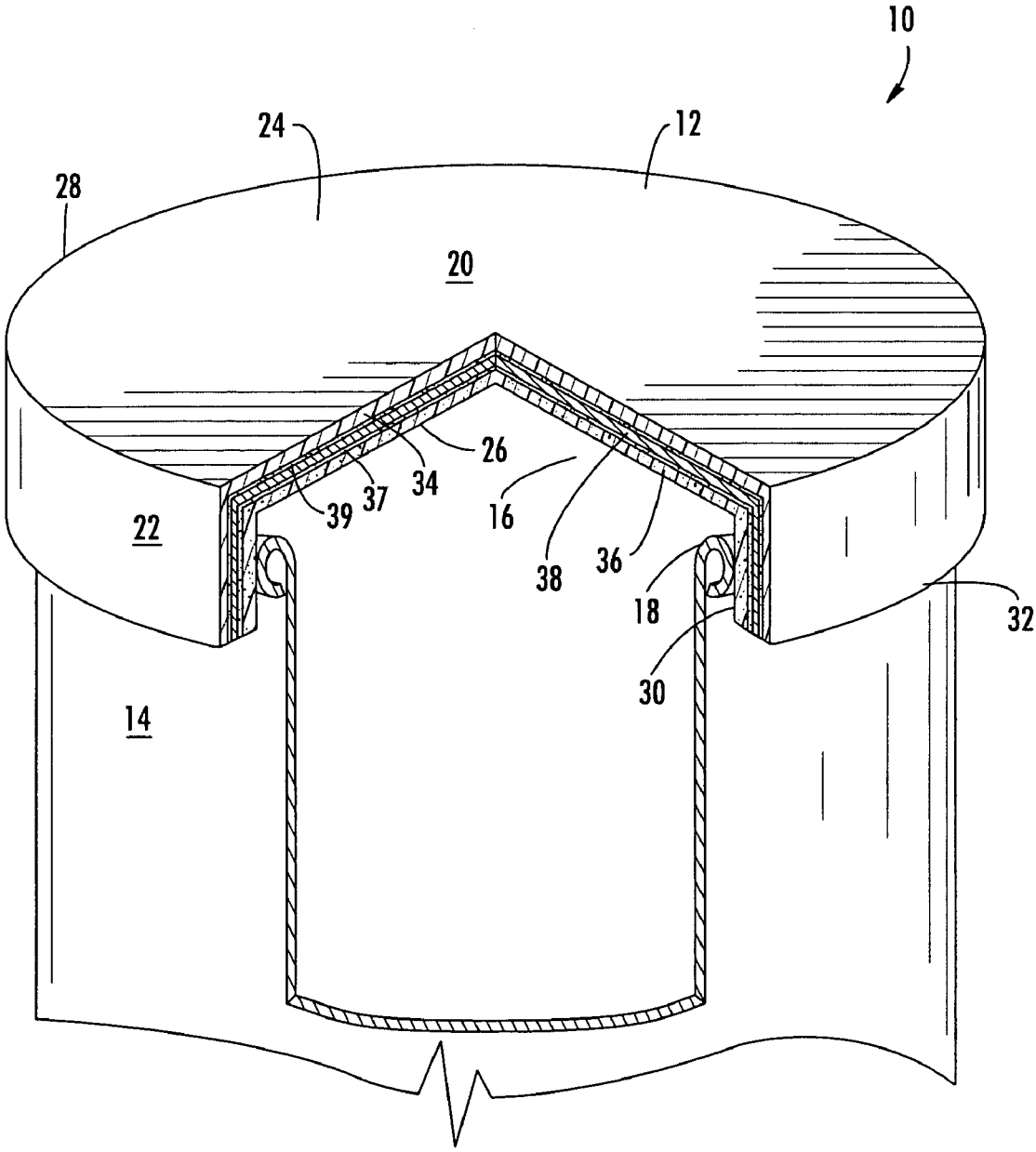
Figure 2:
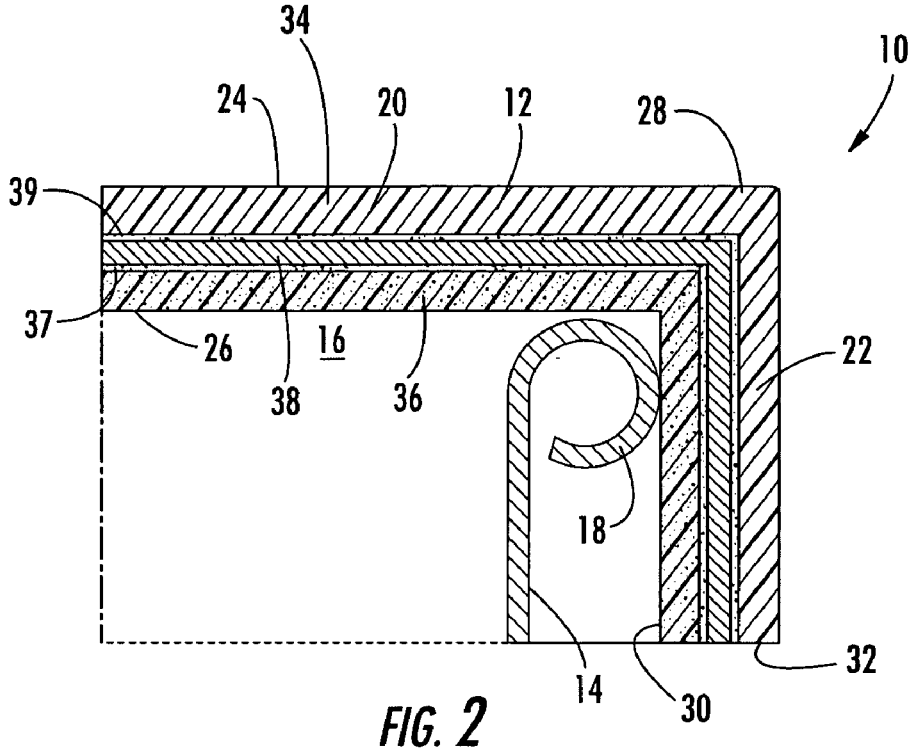
Figure 3:
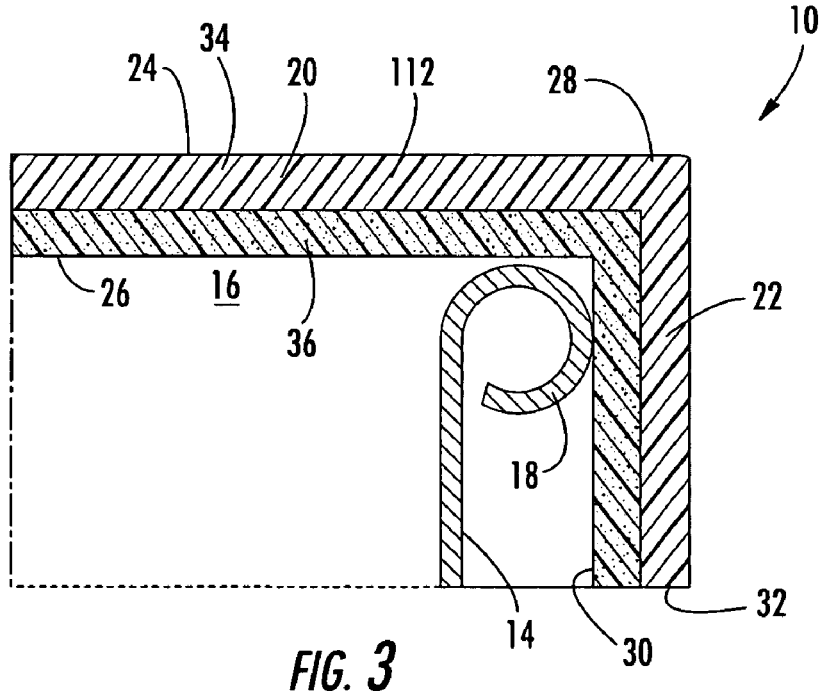
Figure 4:
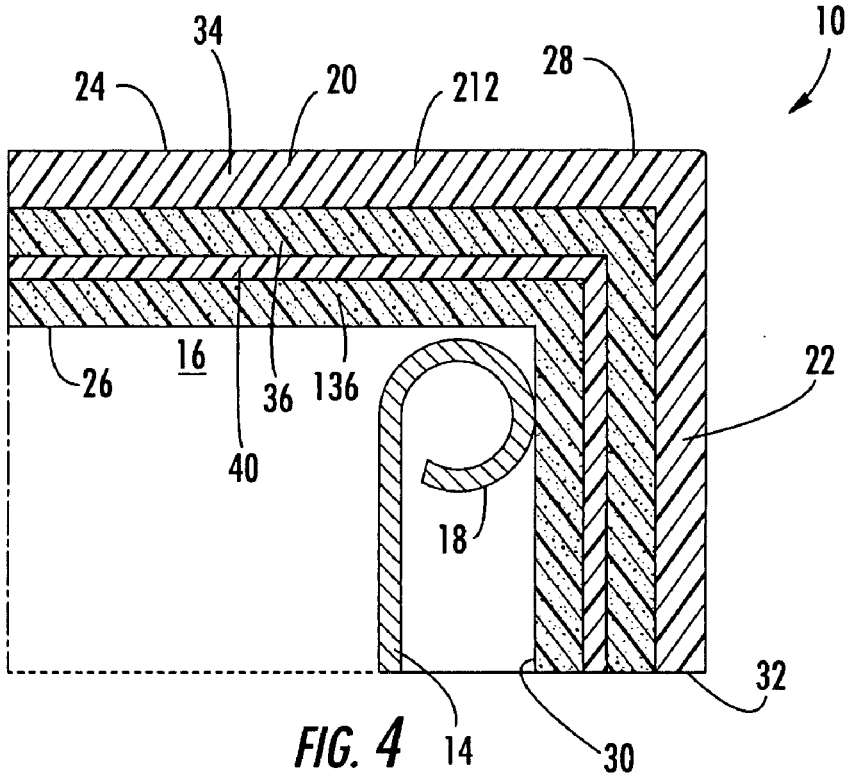
Figure 5:
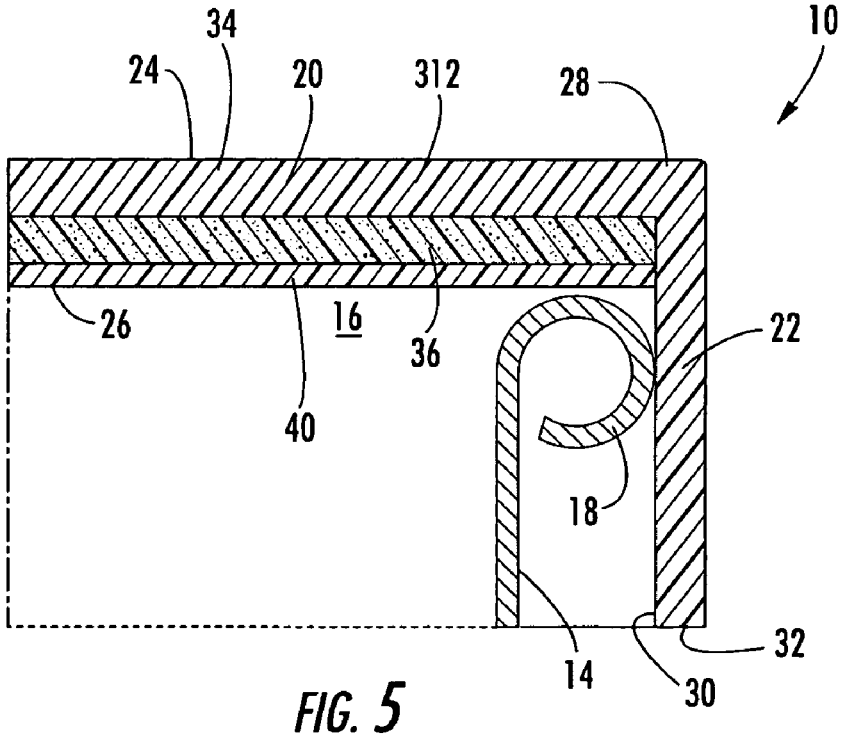

Having thus described the invention in general terms, reference will now be made to the accompanying drawings, which are not necessarily drawn to scale, and wherein:

FIG. 1 is a perspective view of an overcap, partially in section, in accordance with an embodiment of the present invention;

FIG. 2 is a schematic, cross-sectional view of the overcap of FIG. 1, showing a top portion and connecting portion that include a top layer, a barrier layer, and a drying agent layer;

FIG. 3 is a schematic, cross-sectional view of an overcap in accordance with a second embodiment of the present invention, showing a top portion and connecting portion that include a top layer and a drying agent layer;

FIG. 4 is a schematic, cross-sectional view of an overcap in accordance with a third embodiment of the present invention, showing a top portion and connecting portion that include a top layer, a drying agent layer, a polymer layer, and a second drying agent layer; and FIG. 5 is a schematic, cross-sectional view of an overcap in accordance with a fourth embodiment of the present invention, showing a top portion that includes a top layer, a drying agent layer, and a polymer layer.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

With reference to FIGS. 1–2, a sealable storage device in accordance with one embodiment of the invention is illustrated. The storage device 10 includes an overcap 12 and a container 14. The container 14 is structured to store products within the container and to provide access to the stored products through an opening 16. Many types of products can be stored in the storage device 10; however, the storage device is suited to store perishable products because the overcap 12 is resealable such that the stored product is sealed prior to its first use and between subsequent uses.

The container 14, as illustrated in FIG. 1, is a cylindrical tube, such as a paperboard tube. Further embodiments of the invention may include containers 14, and corresponding overcaps 12, that are of any geometric shape and/or material. The container 14 of FIG. 1 is formed by a wall and defines an opening 16. The opening 16 provides access to an interior of the container and is encircled by a radially outwardly protruding rim 18. The rim 18 of the illustrated container 14 is an outwardly rolled bead. Other containers 14 of the present invention may include a rim 18 of any configuration, or may lack a rim.

The overcap 12 of FIG. 1 includes a top portion 20 and a connecting portion 22. The top portion 20 includes an outside surface 24 that is the top surface of the top portion and an inside surface 26 that is a bottom surface of the top portion. The top portion 20 is structured and arranged to cover the opening 16 of the container such that the inside surface 26 faces an interior of the container 14. The top portion 20 defines a generally planar surface and may include additional features on the outside surface 24 and the inside surface 26 of the top portion. The top portion 20 also defines a periphery 28 proximate the circumference of the top portion.

The connecting portion 22 of the overcap 12 is structured and arranged to create a sealed interface with the container. The connecting portion 22 extends downward from the periphery 28 of the top portion 20. The connecting portion 22 of the illustrated storage device 10 is a skirt that includes an inner surface 30 that engages the rim 18 of the container 14 to create a sealed interface. The overcap 12 of further embodiments may include alternative connecting features, and such features may be located at radial distances inside or beyond the periphery 28 or located above the top portion 20. Such features may include surfaces to facilitate the disconnecting or connecting of the overcap 12 from the container 14. The connecting portion 22 of the illustrated overcap 12 extends generally perpendicular from the top portion 20 to a distal end 32. Other embodiments of the overcap 12 may include a connecting portion 22 that extends from the top portion 20 at a non-perpendicular angle.

The top portion 20 of the overcap 12 includes a top layer 34 and a drying agent layer 36 positioned below the top layer such that the drying agent layer is the bottom layer of the top portion. The drying agent layer 36 of the overcap 12 thus defines the inside surface 26 of the top portion 20. The drying agent layer 36 is exposed to moisture within the interior of the container 14 when the overcap is connected to the container. The drying agent layer 36 of the illustrated overcap includes a polymer material and a drying agent material dispersed in the polymer material. Examples of suitable drying agent materials that can be used include but are not limited to sodium phosphate di-basic, calcium oxide, sucrose, gelatin, bentonite clay, and silica gel. However, other embodiments of the invention may include a drying agent layer 36 of any material that absorbs moisture.

The drying agent layer 36 of the overcap 12 of FIG. 1 is joined to a barrier layer 38 that is joined to the top layer 34. The top layer 34 of the overcap 12 may comprise a polymer that is not a particularly good barrier against the passage of water vapor. The barrier layer 38 of the overcap 12 is a barrier material that prevents the passage of moisture (and possibly other substances such as oxygen) into the container 14 and prevents the drying agent layer 36 from being exposed to atmospheric moisture vapor outside the container when the overcap is attached to the container. Therefore, the barrier layer 38 provides an improved barrier to water vapor when compared to the overcap of FIG. 3, which does not include a barrier layer. The barrier layer 38 of FIG. 2 can be formed of various materials, which include but are not limited to metal foil, polyethylene terephthalate, metallized polyethylene terephthalate, metal oxide and silicate coated polyester, and mixtures thereof.

The top layer 34 of the illustrated overcap 12 may comprise a polymer material that may also allow some passage of oxygen, which may then pass through the drying agent layer 36 to contact the stored product. The barrier layer 38 may also provide an improved barrier to oxygen when compared to the overcap of FIG. 3. In addition to the non-limiting examples of barrier materials listed above, an ethylene vinyl alcohol copolymer material can also be used as the barrier membrane to minimize or prevent the passage of oxygen through the overcap 12; however, because exposure to moisture degrades the oxygen barrier performance of some ethylene vinyl alcohol copolymer materials, such exposure to moisture should be limited or prevented by the materials surrounding the barrier membrane.

Adhesives or tie layers may be necessary or desirable for joining the barrier layer 38 to the top layer 34, to the drying agent layer 36, or to other layers. For example, the barrier layer 38 of FIGS. 1 and 2 is joined to the drying agent layer 36 by a first tie layer 37 and joined to the top layer 34 by a second tie layer 39. The tie layers 37 and 39 of the illustrated overcap 12 are adhesive layers; however, tie layers of any material or from any process that suitably join the barrier layer 38 to the adjacent layers may be used.

The overcap 12 of FIG. 2 includes the drying agent layer 36 in the connecting portion 22. A segment of the drying agent layer 36 is located between the sealed interface and the distal end 32 of the connecting portion 22, and that segment is exposed to the atmosphere surrounding the container 14 and may absorb atmospheric moisture. Such absorption of atmospheric moisture may exhaust the moisture absorbing ability of the segment of the drying agent layer 36. However, such absorbed moisture does not significantly propagate above the sealed interface. Therefore, the absorbed moisture of the segment below the sealed interface has a minimal effect on the moisture absorbing ability of the drying agent layer 36 exposed to the interior of the container 14.

FIG. 3 depicts an alternative embodiment of an overcap 112 in accordance with the invention. The overcap 112 includes a drying agent layer 36 joined directly to the top layer 34 of the top portion 20 such that the drying agent layer is the bottom layer of the top portion. In this embodiment, the material of the top layer 34 preferably should have good moisture barrier properties so that the drying agent layer is isolated from atmospheric moisture outside the container through the top portion 20 and the skirt 22. However, similar to the overcap 12 of FIG. 2, the segment of the drying agent layer 36 between the sealed interface and the distal end 32 will be exposed to atmospheric moisture, but the moisture will not significantly propagate above the sealed interface and thus will not exhaust the drying agent layer exposed to the interior of the container 14.

FIG. 4 also illustrates an overcap 212 with a drying agent layer 36 joined directly to the top layer 34 of the top portion 20, but in this embodiment the overcap also includes an intermediate polymer layer 40 joined to the drying agent layer and a second drying agent layer 136 joined to the intermediate polymer layer such that the second drying agent layer is the bottom layer, and defines the inside surface 26, of the top portion. The polymer layer 40 comprises a material that is relatively permeable to water vapor compared to the top layer 34. The overcap 212 of FIG. 4 provides additional moisture absorbing ability because moisture absorbed by the second drying agent layer 136 is able to pass through the polymer layer 40 to be further exposed to, and absorbed by, the drying agent layer 36. The rate of moisture passage through the polymer layer 40 is generally proportionate to the thickness of the polymer layer. Embodiments of overcap 212 having a top layer 34 and a polymer layer 40 of the same material include a polymer layer of less thickness than the top layer. Because the top layer 34 has a thickness greater than the polymer layer 40, the drying agent layer 36 is exposed to and absorbs relatively more moisture from the interior of the container through the second drying agent layer 136 and the polymer layer than from the atmosphere through the top layer. However, similar to the embodiments of FIGS. 2 and 3, the segments of the drying agent layers 36 and 136 of FIG. 4 below the sealed interface will absorb atmospheric moisture; however, such absorption is preferably limited to that segment such that it has a minimal effect on the drying agent layers above the opening 16 of the container 14.

FIG. 5 illustrates an overcap 312 with a drying agent layer 36 positioned below the top layer 34 and a polymer layer 40 positioned below the drying agent layer such that the polymer layer is the bottom layer, and defines the inside surface 26, of the top portion 20. The polymer layer 40 of FIG. 5 allows passage of moisture so that moisture can be exposed to, and absorbed by, the drying agent layer 36, with the rate of moisture passage (for a given material) depending upon the thickness of the polymer layer. The polymer layer 40 prevents direct contact between the drying agent layer and the contents of the container, which may be desirable in some cases. The polymer layer 40 can also prevent the drying agent layer from inadvertently being wetted by liquid water, such as when the overcap 312 is detached from the container. The skirt 22 of the overcap 312 of FIG. 5 does not include the drying agent layer 36 and the polymer layer 40, but consists only of the top layer 34. Therefore, the skirt does not include a segment of drying agent layer 36 that is exposed to moisture in the atmosphere surrounding the container 14 as in the overcaps of FIGS. 2–4.

The top layer 34 of the illustrated overcaps is a polymer material that is formed into the shape of the overcap through a suitable process such as thermoforming or injection molding. The overcap can be formed of various polymer materials, including but not limited to polypropylene, other polyolefins (including homopolymers, co-polymers, etc.) such as polyethylene, polyester, polystyrene, elastomers (including thermoplastic rubber, thermoplastic elastomer, etc.), and mixtures or combinations thereof.

To manufacture the overcap by a thermoforming process, the individual materials are coextruded into a multilayered sheet. The overcap 12 of FIG. 1 may be formed from a coextruded sheet with a top layer of polymer material, a middle layer of barrier material, and a bottom layer of drying agent material mixed with a polymer material. After thermoforming and hardening, the polymer material defines the top layer 34, the barrier material defines the barrier layer 38, and the drying agent material defines the drying agent layer 36. Likewise, the overcap 112 of FIG. 3 may be formed from a coextruded sheet with a top layer of polymer material and a bottom layer of drying agent material mixed with a polymer material. After thermoforming and hardening, the polymer material defines the top layer 34 and the drying agent material defines the drying agent layer 36.

Furthermore, the overcap 212 of FIG. 4 may be formed from a coextruded sheet with a top layer of polymer material, an upper middle layer of drying agent material mixed with a polymer material, a lower middle layer of polymer material, and a bottom layer of drying agent material mixed with a polymer material. After thermoforming and hardening, the polymer material defines the top layer 34, the drying agent material defines the drying agent layer 36, the layer of polymer material defines the polymer layer 40, and the bottom layer of drying agent material defines the second drying agent layer 136.

Alternatively, to manufacture an overcap, such as the overcap 312 of FIG. 5, by an injection molding process, a drying agent layer 36 and polymer layer 40 (which may be pre-adhered together by a suitable tie layer, not shown, or may be coextruded together) are positioned on the bottom surface of the mold. A thermoplastic material is then injected into the mold above and around the drying agent layer 36 such that the material forming the top layer 34 joins the drying agent layer and the material forming the connecting portion 22 encircles the drying agent layer and the polymer layer 40. After hardening of the thermoplastic material, the resulting overcap 312 is removed from the mold and is ready for connecting to a container 14. Similar methods are available for the overcaps of further embodiments wherein a single-layer or multiple-layer coextruded sheet is inserted into the mold prior to injection of the thermoplastic material.

A sheet having a drying agent layer 36 (with or without one or more additional layers that can be coextruded with the drying agent layer) may also be joined to the overcap subsequent to the manufacture of the overcap. The sheet may include an adhesive layer on an upper surface of the sheet or the adhesive may be applied to the top layer 34 of the overcap 12 or to the upper surface of the sheet. The sheet is joined to the overcap 12 after the overcap has been manufactured by a suitable manufacturing process. Once the adhesive is either applied or exposed, depending upon the type of adhesive used, the sheet is pressed against the top layer 34 of the overcap 12 such that the adhesive joins the sheet to the top layer. Sufficient time for the adhesive to set or harden should be provided before the overcap 12 is handled in such a way that could impair the adhesion between the overcap and the sheet. Exposure of an overcap to moisture in the atmosphere after it is manufactured and before it is connected to a container 14 should be minimized, regardless of the manufacturing method used, so that the moisture absorbing ability of the drying agent layer 36 is not reduced by the atmospheric moisture.

Overcaps with no drying agent layer in the skirt 22 are preferably manufactured using the injection molding process wherein the drying agent layer is incorporated into the top portion 20 during molding or subsequently joined to the top portion using an adhesive. Overcaps wherein the skirt 22 includes a drying agent layer 36 are preferably manufactured by thermoforming. However, overcaps with a drying agent layer 36 in the skirt 22 can be manufactured other than by thermoforming processes, such as by injection molding as noted above, and overcaps without a drying agent layer in the skirt can be manufactured using a thermoforming process.

The overcap of the present invention reduces moisture in the interior of the container 14 when the overcap is connected to the container to create a sealed interface. Containers in accordance with the invention may include a removable membrane lid that is attached to the top end of the container when the container is filled at the packaging plant. The membrane lid seals the opening of the container such that the drying agent layer 36 is not exposed to the interior of the container prior to the initial opening of the container by a consumer. However, once the membrane lid has been removed to provide access to the stored product, replacement of the overcap allows the drying agent layer 36 to absorb moisture from the interior of the container. This reduction of moisture can delay or prevent the spoilage of some products, and can help maintain crispness of products such as chips, crackers, or the like. Furthermore, the overcap 14 may also include oxygen scavengers to absorb oxygen from the interior of the container. Non-limiting examples of oxygen scavengers include antioxidants such as butylated hydroxyanisole, propyl gallate, and phenylenethiourea.

An overcap that includes a drying agent layer 36 prevents the drying agent from becoming mixed with the stored product and minimizes or eliminates the direct contact between the drying agent and the stored product. Therefore, the drying agent layer 36 can improve the shelf life of the stored product in the storage device 10 without adversely affecting the quality or use of the stored product.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An overcap for sealing an opening of a container and reducing an amount of moisture within the container, the overcap comprising:

a top portion having an outside surface and having an inside surface opposite the outside surface, wherein the top portion is structured and arranged to cover the opening of the container such that the inside surface faces an interior of the container;

a connecting portion extending from the top portion of the overcap, wherein the connecting portion is structured and arranged to create a sealed interface with the container; and the top portion including a top layer that defines the outside surface of the top portion, a drying agent layer positioned below the top layer such that the drying agent layer is exposed to moisture within the interior of the container and is operable to absorb moisture from the interior of the container, and a moisture-permeable polymer layer, wherein the drying agent layer comprises a polymer material having a drying agent material dispersed therein and is positioned between the top layer and the moisture-permeable polymer layer such that moisture from the interior of the container must pass through the moisture-permeable polymer layer to reach the drying agent layer, wherein the drying agent layer and moisture-permeable polymer layer are coextruded.

2. An overcap according to claim 1, wherein the top portion and the connecting portion comprise polymer material.

3. An overcap according to claim 1, wherein the overcap is formed from a coextruded sheet comprising the top layer, the drying agent layer, and the moisture-permeable polymer layer.

4. An overcap according to claim 2, wherein the overcap includes multiple drying agent layers.

5. An overcap according to claim 1, further comprising a barrier layer, wherein the barrier layer is positioned between the top layer and the drying agent layer.

6. An overcap according to claim 1, wherein the drying agent layer is joined to the top layer of the top portion with an adhesive.

7. An overcap according to claim 1, wherein the top portion of the overcap defines a periphery and the connecting portion defines a skirt extending from the periphery of the top portion to a distal end.

8. An overcap according to claim 7, wherein the skirt encircles the drying agent layer.

9. An overcap according to claim 1, wherein the drying agent layer includes an oxygen scavenger.

10. A resealable container, comprising:

a container body formed by a wall and defining an opening in the wall such that the container body defines an interior of the container, wherein a rim encircles the opening; and an overcap comprising:

a top portion having an outside surface and having an inside surface opposite the outside surface, wherein the top portion is structured and arranged to cover the opening of the container such that the inside surface faces an interior of the container;

a connecting portion extending from the top portion of the overcap, wherein the connecting portion is structured and arranged to attach to the rim of the container and to create a sealed interface with the container; and the top portion including a top layer that defines the outside surface of the top portion, a drying agent layer positioned below the top layer such that the drying agent layer is exposed to moisture within the interior of the container and is operable to absorb moisture from the interior of the container, and a moisture-permeable polymer layer, wherein the drying agent layer comprises a polymer material having a drying agent material dispersed therein and is positioned between the top layer and the moisture-permeable polymer layer such that moisture from the interior of the container must pass through the moisture-permeable polymer layer to reach the drying agent layer, wherein the drying agent layer and moisture-permeable polymer layer are coextruded.

11. A resealable container according to claim 10, wherein the container body is a paperboard tube.

12. A resealable container according to claim 11, wherein the rim of the container is a rolled bead.

13. A resealable container according to claim 10, wherein the top portion and the connecting portion comprise polymer material.

14. A resealable container according to claim 13, wherein the overcap is formed from a coextruded sheet comprising the top layer, the drying agent layer, and the moisture-permeable polymer layer.

15. A resealable container according to claim 13, wherein the overcap includes multiple drying agent layers.

16. A resealable container according to claim 10, further comprising a barrier layer, wherein the barrier layer is positioned between the top layer and the drying agent layer.

17. A resealable container according to claim 10, wherein the drying agent layer is joined to the top layer of the top portion with an adhesive.

18. A resealable container according to claim 10, wherein the drying agent layer includes an oxygen scavenger.

* * * * *